United States Patent [19]

Goode

[11] Patent Number: 4,479,334

[45] Date of Patent: Oct. 30, 1984

[54] LINER FOR TOWER SILO AND METHOD OF INSTALLING SAME

[76] Inventor: John T. Goode, 11731-99th Place North, Osseo, Minn. 55369

[21] Appl. No.: 331,535

[22] Filed: Dec. 17, 1981

[51] Int. Cl.[3] ..... E04H 7/00

[52] U.S. Cl. ..... 52/197; 52/245; 52/247; 52/249

[58] Field of Search ..... 52/249, 247, 245, 192, 52/193, 195, 196, 197

[56] References Cited

U.S. PATENT DOCUMENTS

| | | | |
|---|---|---|---|
| Re. 25,863 | 9/1965 | Laidig | 214/17 |
| 2,722,171 | 11/1955 | Deringer | 99/235 |
| 2,876,927 | 3/1959 | Henning | 220/63 |
| 3,054,523 | 9/1962 | Batzer | 52/249 |
| 3,058,623 | 10/1962 | Hawk et al. | 222/95 |
| 3,092,010 | 6/1963 | O'Dell | 52/197 |
| 3,122,985 | 3/1964 | Osborne | 99/235 |
| 3,167,209 | 1/1965 | Jones | 220/63 |
| 3,623,629 | 11/1971 | Hendershot | 220/63 |
| 3,664,072 | 5/1972 | Lieckfeld | 52/63 |
| 3,823,852 | 7/1974 | Nikowitz | 222/185 |
| 3,924,367 | 12/1975 | Stewart | 52/80 |
| 3,956,859 | 5/1976 | Ingeström | 52/169.11 |
| 4,121,389 | 10/1978 | Ptaszek | 52/52 |

FOREIGN PATENT DOCUMENTS

| | | | |
|---|---|---|---|
| 509306 | 1/1955 | Canada | 52/192 |
| 801318 | 12/1968 | Canada | 52/192 |
| 2388733 | 12/1978 | France | 52/192 |
| 476905 | 12/1937 | United Kingdom . | |
| 657909 | 9/1951 | United Kingdom . | |
| 1193183 | 5/1970 | United Kingdom . | |
| 1193496 | 6/1970 | United Kingdom . | |
| 1258991 | 1/1972 | United Kingdom . | |
| 2051939 | 1/1981 | United Kingdom . | |

OTHER PUBLICATIONS

PCT application 8102035, Jul. 1981, PCT date 1/15/1981.

Brochure-*A. O. Smith Sweep-Arm Auger Bottom Unloader.*

Brochure-*Harvestore Systems Product Buyer's Guide.*

Brochure-*Nutri-Matic Madison Silo.*

*Primary Examiner*—Henry E. Raduazo

*Attorney, Agent, or Firm*—Burd, Bartz & Gutenkauf

[57] ABSTRACT

A conventional tower silo is converted to a limited oxygen feed storing silo with the use of an air impervious liner and a floor supporting a bottom unloader. The liner has plastic liner sheets attached to the inside surface of the silo side wall with fasteners, as adhesives and nut and bolt assemblies. Supports mounted on the silo side wall under the roof carry the upper end of the liner. In one form, a plurality of springs connected to the supports and liner yieldably support the upper end of the liner in the silo. An inside wall surrounding base aggregate supports the floor independently of the silo side wall. The floor has a radial trough accommodating the bottom unloader.

55 Claims, 15 Drawing Figures

2
24
94
27
28
57
20
26
22
23
57
21
2

41
23
58
57
22
51
52
23

52
23
22
59
61

77
88
28
94
24
43B
69
96
55
22
64
42B
66
6
43
44
45
46
47
48
49
50
41
6
5
42
51
22
5
23
7
7
36
38
31
33
37
39
34
42A
32
21
21
29
29

Fig. 8
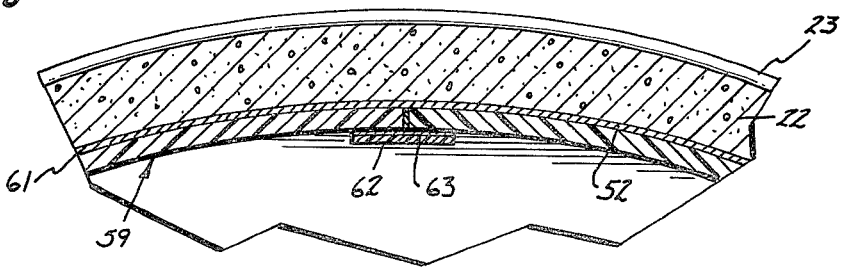
Fig. 7
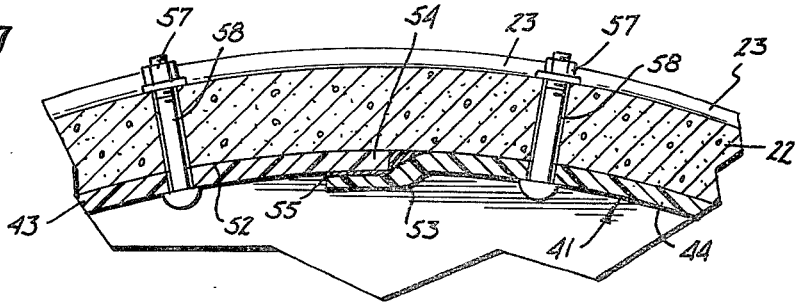
Fig. 9
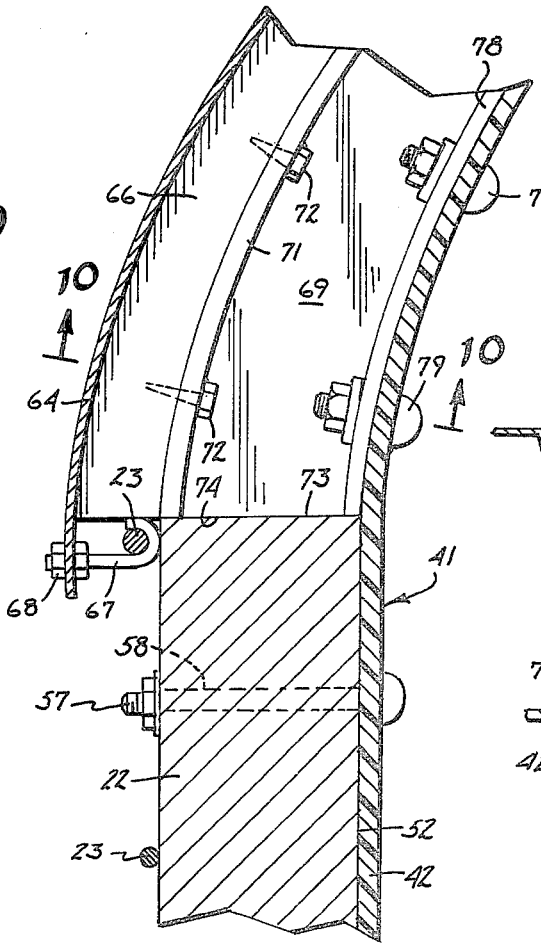
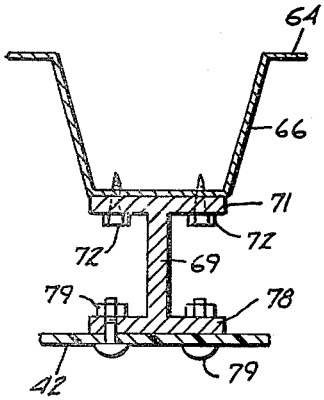
Fig. 10

Fig. 11
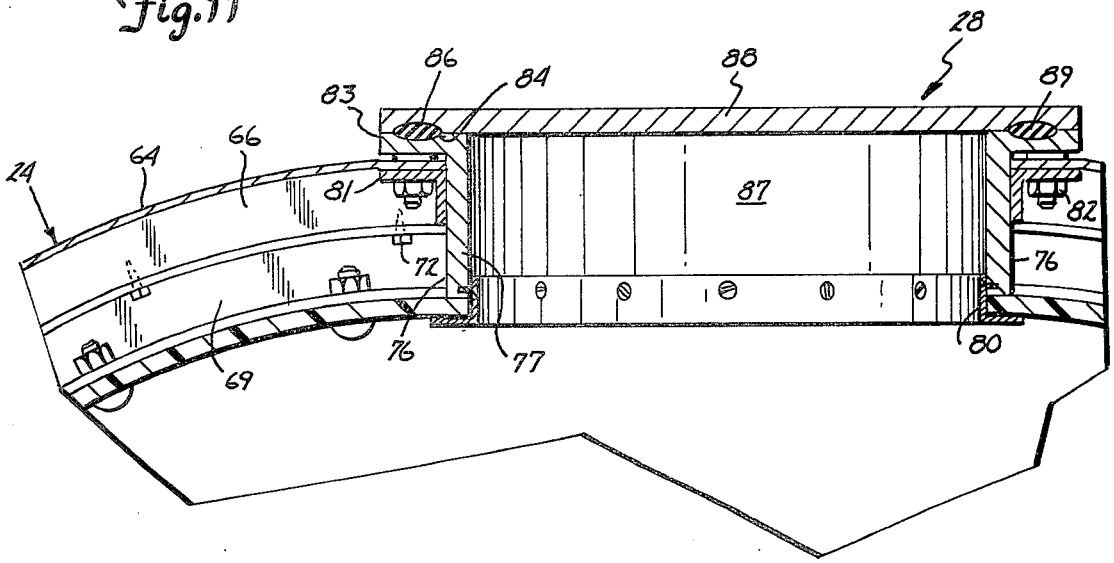
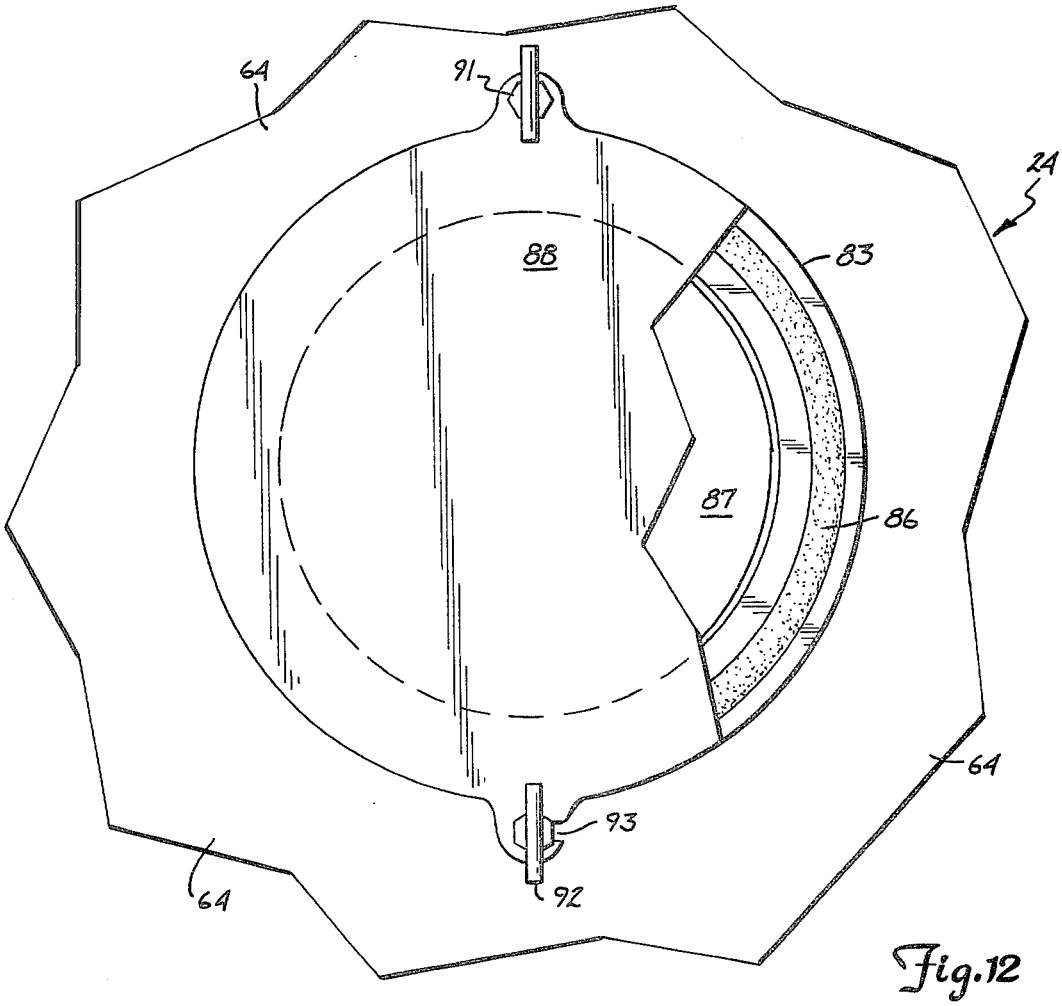
Fig. 12

Fig. 13
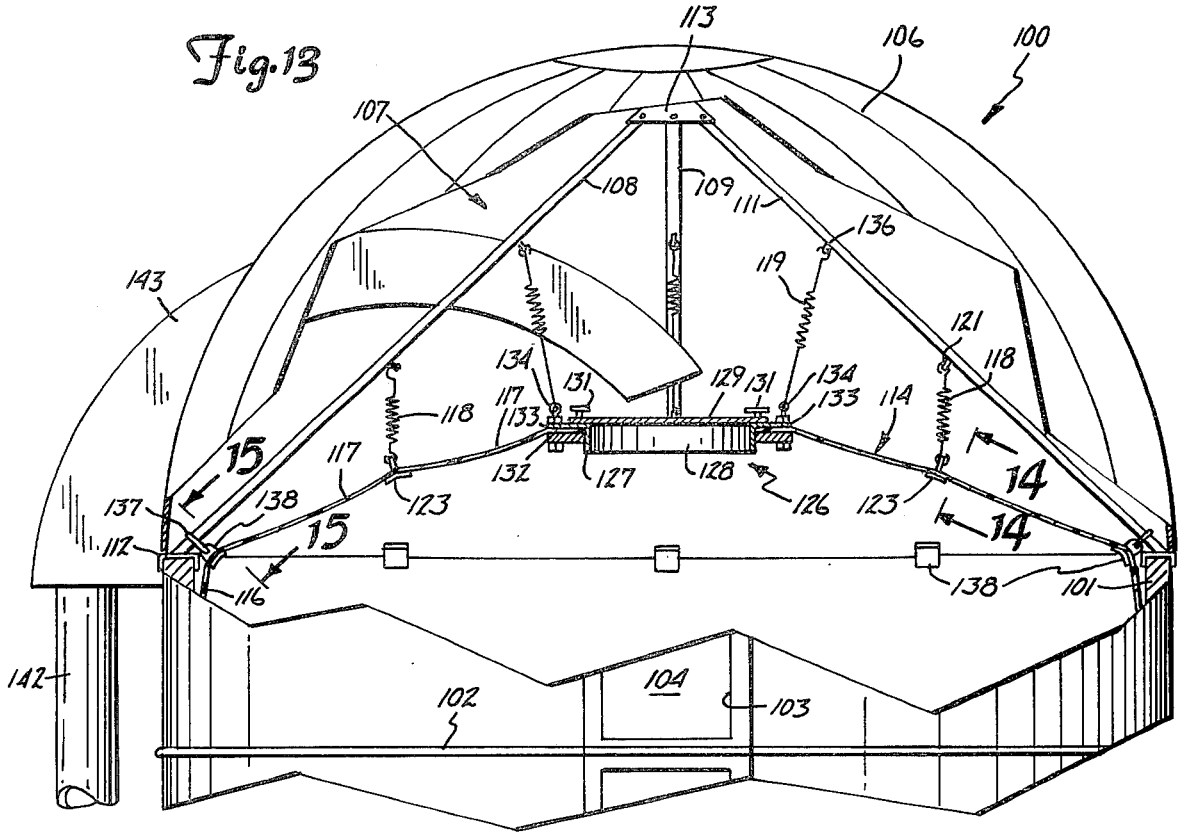
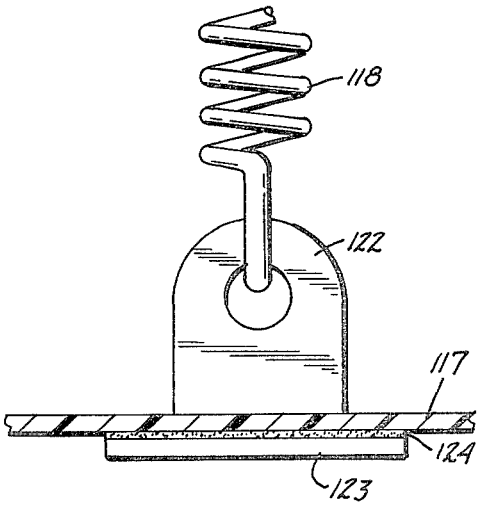
Fig. 14
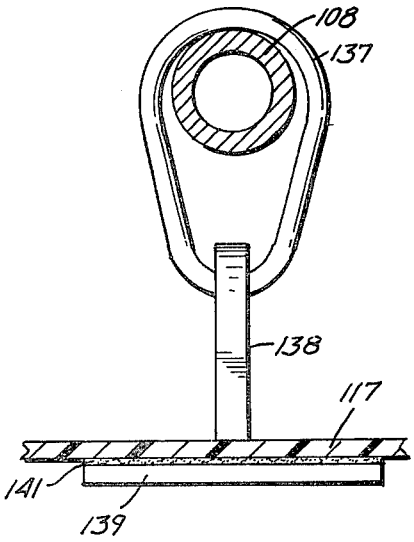
Fig. 15

LINER FOR TOWER SILO AND METHOD OF INSTALLING SAME

FIELD OF INVENTION

The invention involves tower silos, liners for tower silos, floors and bottom unloaders for use with tower silos, and a method and apparatus for converting a tower silo to a bottom unloading sealed tower silo.

BACKGROUND OF INVENTION

Tower silos are used to store bulk materials and forage feeds for animals, such as silage and haylage. The silos are of two general types, i.e., (1) a top unloading unsealed tower silo, and (2) a bottom unloading sealed tower silo. Top unloading machines are used to remove material from unsealed tower silos. The top layer of the material must be timely removed to minimize the spoilage as the material is exposed to atmospheric air. The oxygen in the air promotes mold growth in the material.

Sealed tower silos are used with bottom unloaders to remove material from the bottom of the silo. These silos have air impervious side walls and treated side walls to minimize the leakage of air into the silo. The sealed silos limit the supply of oxygen in the silo, thereby reducing the spoilage of the silage. The sealed tower silos require substantial amounts of labor, time, and capital to construct.

Bag structures have been used with sealed silos to compensate for differences in the air pressure inside and outside of the silo. Deringer in U.S. Pat. No. 2,722,171 discloses a tower silo having a flexible bag for storing silage. The bottom end of the bag is attached to the silo wall. A cable and pulley arrangement is used to support the bag in the silo. The bag rests on top of the silage and is free to move downwardly as the silage is withdrawn from the silo with a bottom silo unloader. Osborne in U.S. Pat. No. 3,122,985 discloses a tower silo having an expandable bag to provide a roof for the silo. The bag prevents the escape of internal gases and entrance of the outside air into the silo.

SUMMARY OF INVENTION

The invention relates to a method and apparatus for converting a conventional tower silo into a bottom unloading hermetically sealed silo. Conventional tower silos have annular side walls of concrete and like material and generally, but not always, a dome roof mounted on the top of the side wall. This type of tower silo is converted with the method and apparatus of the invention into a bottom unloading sealed silo by evacuating the inside of the bottom of the silo to expose the lower side wall of the silo. A liner of air impervious sheet material, such as PVC or rubberized material, is located adjacent to the inside surface of the side wall. The liner comprises side-by-side liner sheets secured together along their adjacent edges. In one embodiment, the liner sheets are attached to the inside surface of the side wall with fasteners, adhesives, and the like. In a modified form of the invention, the liner is located adjacent the inside of the side wall of the silo and is resiliently supported from support members mounted on top of the silo wall.

An inner support wall is constructed adjacent the inside of the lower end of the silo wall. The lower end of the liner is interposed between the inner wall and the side wall to anchor the bottom of the liner. The evacuated area surrounded by the inner wall is filled with an aggregate, as sand. A floor, such as a reinforced concrete slab, covers the inner wall and the aggregate fill. The outer perimeter of the floor is separated from the silo side wall by the liner so that the silo floor is free to float independent of the silo wall. The floor has a trough extended radially from the center area of the silo to a side wall. The side wall is provided with an exit opening aligned with the trough for allowing the material to be discharged from the silo. A bottom silo unloader having a collector movable around the floor and a discharge conveyor located in the trough operates to remove material from the silo.

The upper section of the liner is supported below the roof with a plurality of supports, such as arch girts or legs. Each support has a bottom end supported on the top of the side wall and a top end located adjacent a central hatch assembly or structure connecting the top ends of the legs together. Fastening means, such as bolts, rivets, adhesives, and the like, attach the supports to the inside of the roof and attach the upper section of the liner to the supports. In one form, biasing means, as springs, connect the upper section of the liner to the supports to allow the liner to move up and down in the silo to compensate for air pressure differences between the inside and outside of the liner.

An object of the invention is to provide a method and apparatus for converting a conventional tower silo into a substantially air impervious silo useable with a bottom silo unloader to remove silage from the bottom silo. Another object of the invention is to provide a liner for a tower silo that is secured to the inside of the silo wall and secured to support girts located under the silo roof for holding the upper end of the liner in the space immediately below the roof of the silo. A further object of the invention is to provide a liner for a silo that is resiliently suspended from support structure mounted on top of the silo. A further object of the invention is to provide a conventional silo with a floating floor that is free to move independent of the side wall of the silo. These and other objects of the invention are embodied in the following detailed description.

IN THE DRAWINGS

FIG. 7 is an enlarged sectional view taken along the line 7—7 of FIG. 2;

FIG. 8 is a sectional view similar to FIG. 7 showing an adhesive to secure the liner to the inside of the silo wall;

FIG. 9 is an enlarged sectional view showing the liner and liner support joined to the roof;

FIG. 10 is a sectional view taken along the line 10—10 of FIG. 9;

FIG. 11 is an enlarged sectional view of the top of the roof;

FIG. 12 is a top view of FIG. 11 with the cover broken away;

FIG. 13 is a side view of the upper end of a tower silo, partly sectioned, showing a modification of the liner and liner support of the invention;

FIG. 14 is an enlarged sectional view taken along the line 14—14 of FIG. 13; and FIG. 15 is an enlarged sectional view taken along the line 15—15 of FIG. 13.

DESCRIPTION OF PREFERRED EMBODIMENT

Figure 1:
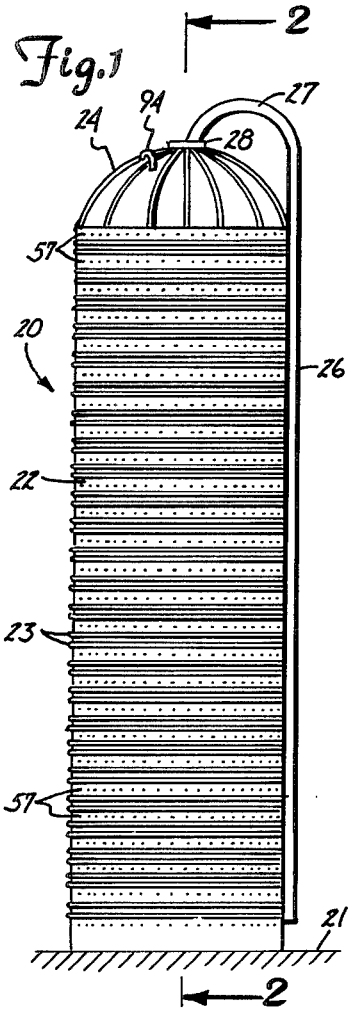
FIG. 1 is a side elevational view of a conventional tower silo equipped with a liner of the invention.
Figure 3:
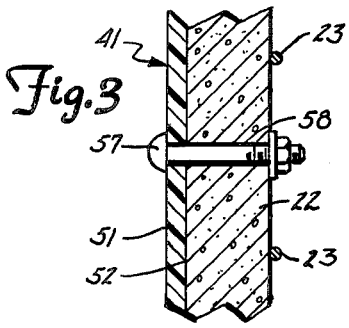
FIG. 3 is an enlarged view of a section of the side wall of the silo showing the attachment of the liner to the silo wall.

Referring to the drawings, there is shown in FIG. 1 a conventional tower silo indicated generally at 20 used to store bulk materials and animal roughages, such as silage and haylage. The bulk materials include all types of materials that are stored in silos including, but not limited to, grains, fertilizers, and cement. The following description uses silage as the material stored in the silo. Silo 20 is a generally cylindrical upright structure anchored in the ground 21. Silo 20 has a circumferentially continuous upright cylindrical side wall 22 surrounded by vertically spaced rings or hoops 23. The hoops 23 engage the outside of side wall 22 and serve to reinforce side wall 22. The side wall 22 is made of rigid material, such as concrete, concrete staves, and the like. The side wall can be a metal. The top of the side wall is closed with a generally dome-shaped roof 24. As shown in FIG. 1, a fill-pipe 26 extends upwardly adjacent the outside of side wall 22 and is joined to a downwardly turned gooseneck 27. The discharge end of gooseneck 27 is aligned with a centrally located hatch assembly 28 located in the center upper portion of roof 24.

Figure 2:
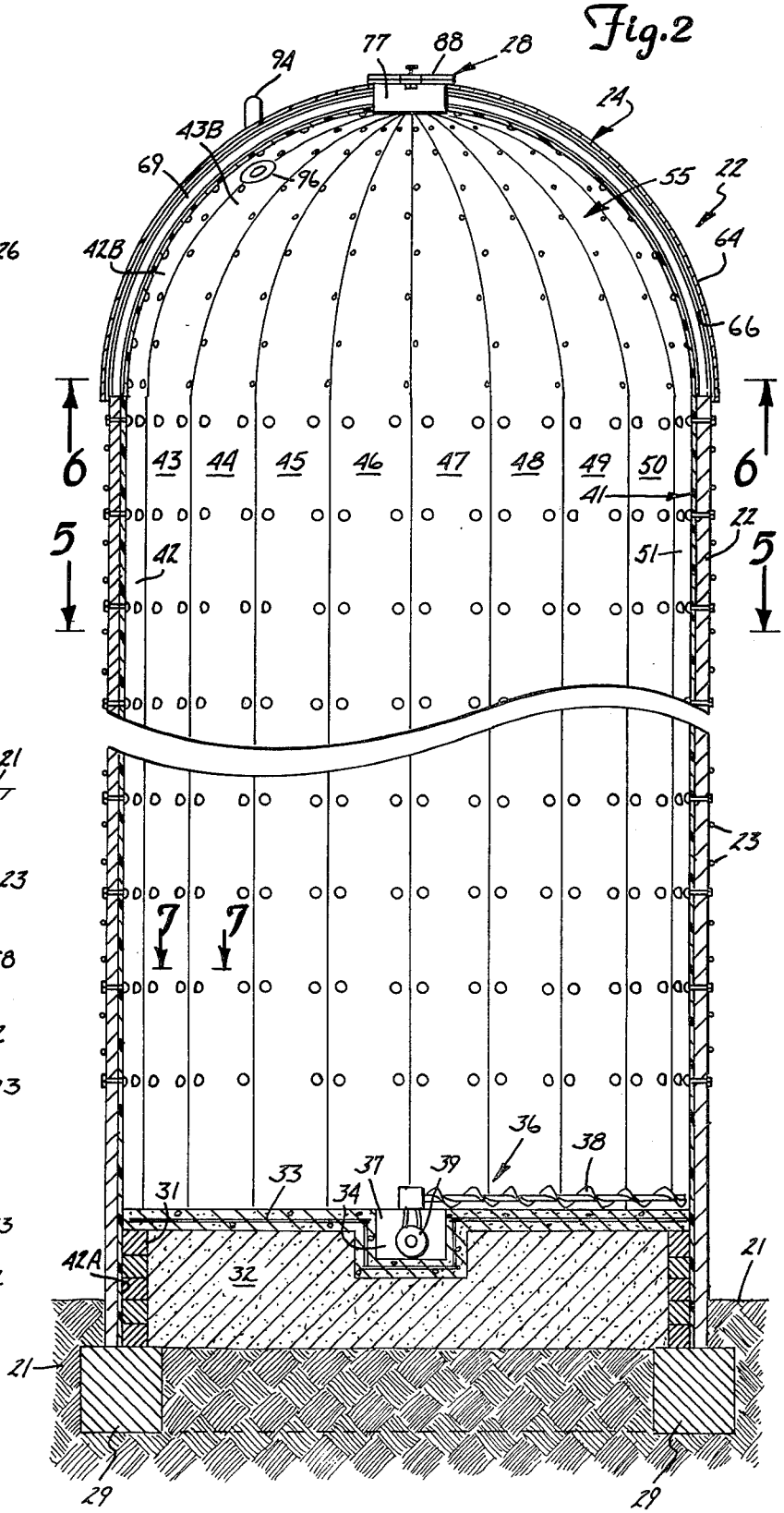
FIG. 2 is an enlarged foreshortened sectional view taken along the line 2—2 of FIG. 1.

As shown in FIG. 2, the bottom of side wall 22 is supported on an annular footing 29. Preferably, footing 29 is a concrete structure located in ground 21. The conventional tower silos have floors at ground level or slightly below ground level.

Figure 5:
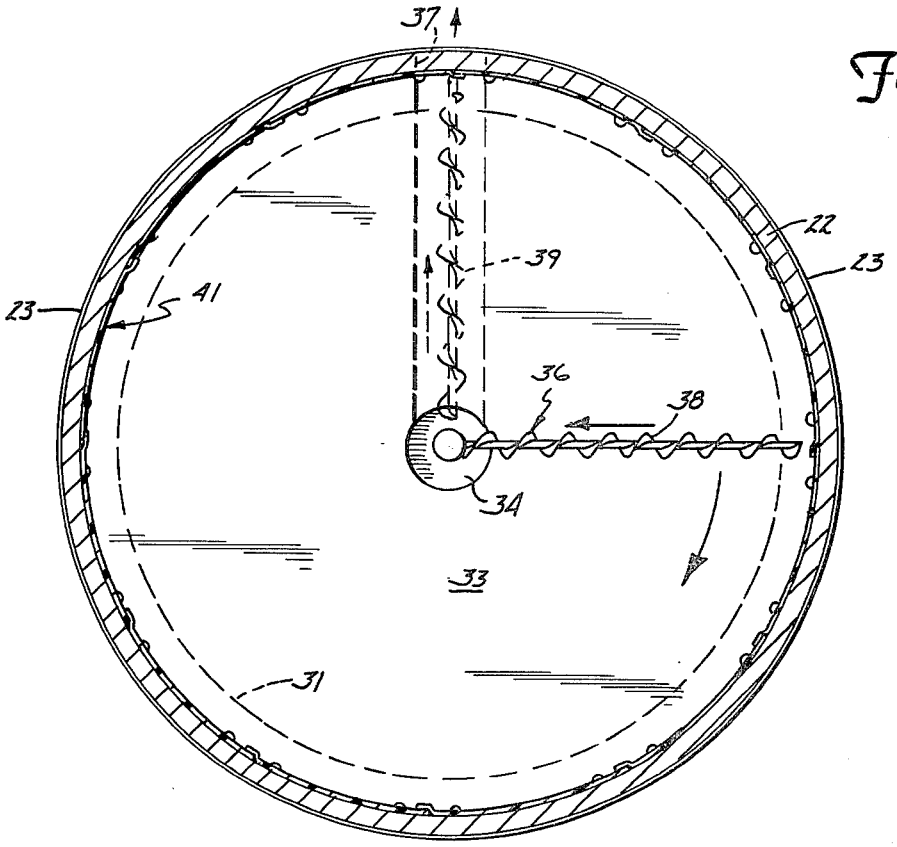
FIG. 5 is an enlarged sectional view taken along the line 5—5 of FIG. 2.
Figure 6:
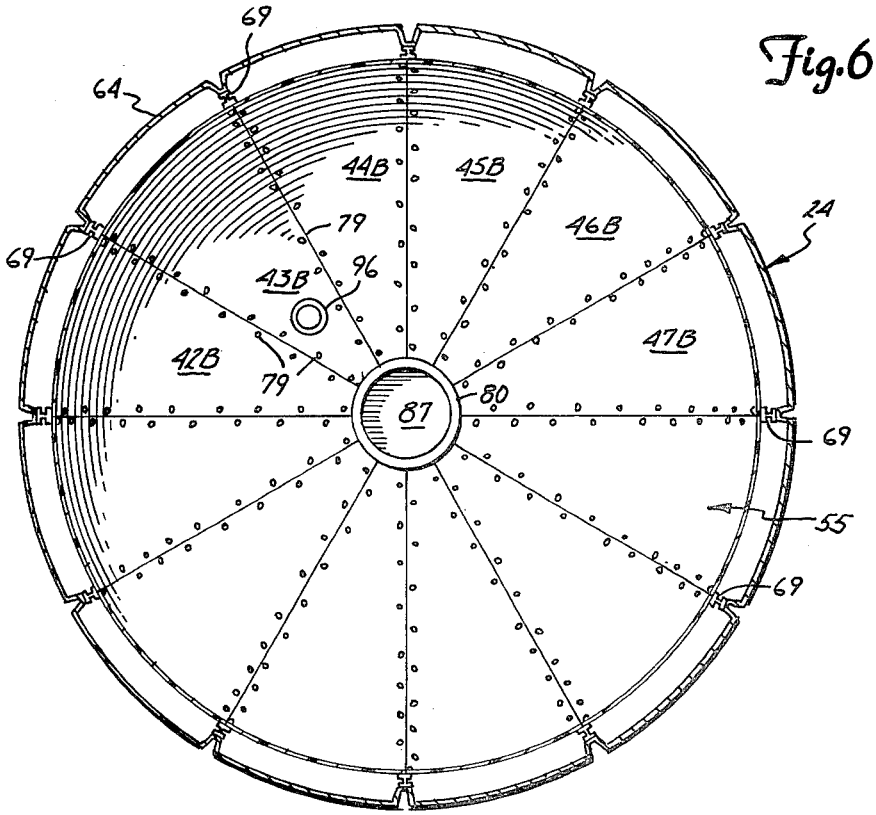
FIG. 6 is an enlarged sectional view taken along the line 6—6 of FIG. 2.

The existing silo floor or bottom material is excavated to the top of footing 29. The inside surface 52 of the side wall 22 is cleaned with high pressure water or sand blasted. The lower portion of an annular liner 41 is located adjacent the cleaned lower portion 42A of side wall 22. An inner annular wall 31 is constructed on top of footing 29 adjacent the inside of silo wall 22. Wall 31 extends upward above ground level. Wall 31 can be concrete block or similar load bearing material. The lower section of liner 41 is sandwiched between the inner wall 31 and side wall 42. The space surrounded by inner wall 31 is filled with an aggregate material 32, such as sand and gravel, to form a base for a generally horizontal floor 33. The floor 33 is a circular rod reinforced concrete slab having a radial trench or channel 34. As shown in FIG. 5, trough 34 extends from the central area of floor 33 to side wall 22. Side wall 22 has an opening 37 aligned with trough 34. Opening 37 may be one of the lower doorways of the silo. A bottom silo unloader indicated generally at 36 is operably located on floor 33 and in channel 34 to remove silage from the bottom of the silo and transfer the silage through opening 37 in side wall 22. The bottom silo unloader 36 is a conventional machine, such as the bottom silo unloader shown by Laidig in U.S. Pat. No. 3,121,501. The unloader 36 has a collector 38 that is driven around the floor 33 and moves the silage radially into a hopper located in trough 34. A conveyor 39 transfers the silage in trough 34 through opening 37 to a discharge location. Additional material handling equipment is used to convey the silage to a desired location, such as an animal bunk feeder. Trough 34 on the floor 33 allows the unloader to be radially moved into and out of the silo. Metal tracks can be provided in the trough 34 to facilitate the installation of the silo unloader.

Referring to FIG. 2, a liner indicated generally at 41 is located adjacent the inside surface of the cylindrical side wall 22 of silo 20. Liner 41 is a gas impervious material that is resistant to the fluids and acids of the silage stored in the silo. For example, liner 41 is made of plastic material, such as polyvinylchloride, polyethylene, or a rubber-like material, as Neoprene. Liner 41 comprises a plurality of longitudinal liner sheets located in side-by-side positions around the inside cylindrical surface 52 of side wall 22. Liner sheets in FIG. 2 are identified by the numbers 42, 43, 44, 45, 46, 47, 48, 49, and 51. The number of longitudinal sheets in the silo depends on the diameter of the silo and the width of the sheets. As shown in FIG. 7, adjacent edges of the side-by-side sheets 43 and 44 are overlapped. Sheet 44 has a lip 53 that extends over an end 54 of sheet 43. An adhesive or bonding material 55 hermetically seals lip 53 to end 54. Alternatively, a plastic weld can be used to secure adjacent edge portions of the liner sheets together. Lip 53 and end 54 extend the length of height of the silo. Upper sections 42B–51B of each of the sheets 42–51 converge or taper to hatch assembly 28 to form a hemispherical-shaped dome 56 directly below roof 24.

Each liner sheet 42–51 is located in surface engagement with the inside surface 52 of side wall 22 and retained there with a plurality of nut and bolt assemblies 57. As shown in FIG. 1, the nut and bolt assemblies 57 extend from the bottom to the top of the silo 20. The bolts extend through holes 58 in the side wall 22. Preferably, the nut and bolt assemblies 57 are plastic fastening structures. Adhesive or bonding material may be used with the heads of the bolts that engage the liner sheets to seal the head to the liner sheets. This prevents leakage of air into the silo around the heads.

Figure 4:
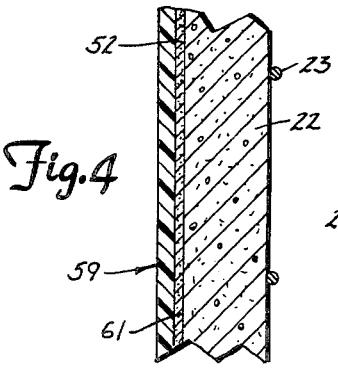
FIG. 4 is a sectional view similar to FIG. 3 showing a modification of the attachment of a liner to the silo wall.

Referring to FIGS. 4 and 8, there is shown an alternate method of attaching a liner 59 to the inside surface 52 of the silo side wall 22. Liner 59 is the same construction as liner 42. An adhesive or bonding layer 61 bonds the entire inside surface of the liner 59 to side wall 22. As shown in detail in FIG. 8, a longitudinal strip 62 of plastic material overlaps the butt or adjacent ends of the liner sheets. Adhesive or bonding material 63 secures the strip 62 to liner sheets 59. Strip 62 strengthens the liner 59 and compensates for variations in width of adjacent strips.

Existing silos can be provided with liner 59. The inside surface of the silo wall is cleaned, such as with high pressure water or sand blasting. The surface can then be treated with a sealant. The adhesive material 61 is then sprayed onto the inside surface of side wall 22. The sheets of liner 59 are then pressed onto the adhesive to securely bond the sheets of liner 59 to side wall 22.

Roof 24, as shown in FIGS. 1 and 2, is a hemispherical or domed structure mounted on top of silo side wall 22. Roof 24 comprises a plurality of tapered arcuate panels 64 joined together with interconnecting side ribs 66. A plurality of J-bolts 67, as shown in FIG. 9, secure each panel to top ring 23 that surrounds silo wall 22. Nuts 68 threaded on J-bolt 67 secure the panel 64 to bolt 67. An example of a panel silo roof structure is shown or disclosed in U.S. Pat. No. 3,924,367.

A plurality of arcuate shaped girts or arched support members 69 are located under roof panels 64. As shown in FIG. 10, member 69 has a generally I-beam shape, with a top flange 71 secured to a panel rib 66 with a plurality of fasteners, such as screws 72. The fasteners can be rivets or nut and bolt assemblies. The member 69 has a bottom end 73 that engages the top 74 of silo side wall 22. As shown in FIG. 11, member 69 has a top end 76 that is located adjacent a sleeve 77 of hatch assembly 28. Member 69 has an inside arcuate inner flange 78 that extends from the inside of silo side wall 22 to the bottom edge of sleeve 77. A plurality of fasteners 79, such as plastic nut and bolt assemblies, or an adhesive, secure liner 41 to flange 78.

Returning to FIG. 11, an annular ring 81 surrounds sleeve 77. A plurality of nut and bolt assemblies 82 secure ring 81 to the inner or upper ends of panels 64. The sleeve 77 has an outwardly directed annular lip or flange 83 located over the nut and bolt assemblies 82. Flange 83 has a top annular groove 84 accommodating a large annular seal 86.

Sleeve 77 provides an opening or passage 87 into the top of the silo chamber surrounded by tubular lining 41. This opening is closed with a generally flat cover 88 mounted on flange 83. As shown in FIG. 11, the inside outer surface of cover 88 has a groove 89 accommodating the upper part of the annular seal 86. Referring to FIG. 12, a pivot bolt 91 and a lock bolt 92 clamp cover 88 into sealing engagement with the annular seal 86 and flange 83. A cover 88 has a circumferential slot 93 adjacent the lock bolt 92. When bolt 92 is released, the cover can swing about the pivot bolt 91 to an open position. When cover 88 is in its open position, opening 87 serves as a fill hole aligned with the end of gooseneck 27.

An air breather pipe and valve unit 94 attached to upper liner section 55 allows limited amounts of air to flow into and out of the space surrounded by liner 41 to maintain the gas pressure in the silo about the same as the external air pressure. Unit 94 has an annular connector with an opening secured with adhesive to liner section 55. Breather pipe and valve unit 94 is a conventional breather valve.

Referring to FIGS. 13–15, there is shown a conventional tower silo indicated generally at 100 having an upright cylindrical side wall 101 reinforced with a plurality of circumferential rings or hoops 102. Side wall 101 has vertically spaced doorways 103 which provide openings into the interior of the silo. The doorways 103 are closed with conventional doors 104. Silos of this type have upright chutes (not shown) mounted on the outside of side wall 101 that cover doorways 103. A dome roof 106 mounted on top of side wall 101 closes the top of the silo. The bottom of silo 100 is identical to the bottom of silo 24, as shown in FIG. 2. The bottom has a floor and a bottom silage unloader.

A support indicated generally at 107 is located immediately under roof 106. Support 107 has three downwardly and outwardly directed legs 108, 109, and 111 mounted on the top of side wall 101 with inverted U-shaped feet 112. Feet 112 are clamped onto side wall 101 to securely fix the support 107 to side wall 101. A connector 113 secures the upper ends of legs 108, 109, and 111. Support 107 is shown as a tripod. Additional legs can be provided.

Support 107 pendently supports a liner indicated generally at 114 extended down into the silo. Liner 114 is made of flexible air impervious material, such as the material of liner 41. Liners 41 and 114 function as a barrier between the silage and the side wall of the silo. The liners 41 and 114 terminate the chemical reaction due to acids, oxygen, and wall material and, thus, stop deterioration of the silo wall. Liner 114 comprises side-by-side liner sheets bonded or plastic welded together forming a cylindrical side 116 extended to the bottom of the silo. Side 116 is pressed into engagement with the inside of silo wall 101 by the silage that is placed in the liner. Liner 114 has an upper liner section 117 that closes the top of the silo. An upper liner section 117 is resiliently supported on support 107 with a plurality of yieldable means, such as coil springs 118 and 119. Each leg 108, 109, and 111 is connected to a pair of springs 118 and 119. Spring 118 has an upper end hooked onto a loop or eye bolt 121 secured to the mid-section of leg 111. Legs 108 and 109 have similar loops or eye bolts for springs 118. The lower end of spring 118 is connected to an eyelet 122, which is secured to upper section 117 of liner 114. As shown in FIG. 14, eyelet 122 has a generally flat base 123 attached with an adhesive or plastic weld 124 to liner section 117. Base 123 has a circular or disc shape. A plurality of similar eyelets are located around liner section 117 to provide connectors for springs 118.

Returning to FIG. 13, the center of upper liner section 117 is attached to a fill hatch assembly indicated generally at 126 providing an access opening 128 to allow material delivered by a fill pipe 142 and gooseneck 143 to be discharged into the storage space surrounded by liner 114. Hatch assembly 126 has a cylindrical sleeve 127 defining the fill opening 128. A cover 129 is used to close opening 128. A plurality of fasteners 131 associated with the cover and sleeve 127 functions to seal the cover on sleeve 127. A ring 132 surrounds sleeve 127 and clamps a portion of liner section 117 against an annular flange 133 secured to the top of sleeve 127. Liner section 117 can be secured to flange 133 with an adhesive in lieu of the nut and bolt fasteners, or used in addition to the nut and bolt fasteners. A plurality of eye bolts 134 cooperates with ring 132 and flange 133 to clamp a liner section 117 to hatch assembly 126.

Springs 119 have upper ends connected to loops or eye bolts 136 secured to upper portions of the legs 108, 109, and 111. The lower ends of the springs 119 are connected to the eye bolts 134 to resiliently support the hatch assembly and center of the liner section 117. Referring to FIG. 15, the outer peripheral portion of the upper liner section 117 is mounted on the lower end of the legs 108, 109, and 111 with rings 137 movably mounted on the legs and eyelets 138. As shown in FIG. 15, eyelet 138 has a base 139 secured with an adhesive or plastic weld 141 to the plastic liner section 117. The rings 137 allow the upper liner section 117 to move up and down in response to the differences in air pressure on the inside and outside of the liner. Biasing members, such as springs, can be interposed between and connected to rings 137 and eyelets 138 to allow limited inward movement of the outer portions of liner section 117.

While there has been shown and described the preferred embodiment of a liner for a tower silo and means for attaching and supporting the liner within the silo and a method of converting an existing tower silo into a sealed bottom unloading silo, it is understood that changes in the structures, materials, and method of converting an existing tower silo to a bottom unloading sealed silo can be made by those skilled in the art without departing from the invention. For example, the liner 41 can be fastened to the inside surface 52 of the silo wall 22 with bolts and an adhesive. The discharge ends of the goosenecks 27 and 143 can be connected to flexible boots attached to open hatch assemblies so that the hatch assemblies need not be closed. The fill pipes are closed to prevent air from flowing into the silo. A return air line is used to draw air out of the silo during the filling of the silo. The biasing members 118 and 119, shown in FIG. 13, can be yieldable elastic cords. The invention is defined in the following claims.

The embodiments of the invention in which an exclusive property or privilege is claimed are defined as follows:

1. An apparatus for converting a conventional tower silo including an upright side wall having an inside surface surrounding a chamber for storing material, an upper end, and a lower end anchored to the ground, a roof mounted on the upper end of the silo wall covering the upper end of the chamber comprising: air impervious liner means located in said chamber adjacent the inside surface of the side wall, means attaching the liner means to the side wall to hold the liner means in engagement with said inside surface, said liner means having an upper portion located below the roof, support means extended upwardly from the side wall below said roof, means attaching the upper portion of the liner means to the support means, air vent means mounted on the upper portion of the liner means operable to allow air to flow into and out of the chamber to substantially equalize the inside and outside air pressure, and floor means at the lower end of the side wall, said floor means having means to accommodate a bottom material unloading machine.

2. The apparatus of claim 1 wherein: said liner means comprises a plurality of upright liner sheets arranged in side-by-side positions adjacent the inside surface of the side wall, adjacent liner sheets having adjacent longitudinal edges, means securing said adjacent edges together, and said means attaching the liner means to the side wall including means to attach each liner sheet to the side wall.

3. The apparatus of claim 2 wherein: said means attaching each liner sheet to the side wall includes fastening means anchored to the side wall holding the liner sheet in engagement with the inside surface of the side wall.

4. The apparatus of claim 3 wherein: the fastening means include nut and bolt assemblies extended through holes in the side wall.

5. The apparatus of claim 2 wherein: said means attaching each liner sheet to the side wall includes adhesive means attaching the outer side of the liner sheet to the inside surface of the silo wall.

6. The apparatus of claim 2 wherein: each liner sheet has an upwardly tapering upper end portion.

7. The apparatus of claim 1 wherein: the support means comprise a plurality of arched girts having lower ends supported on the upper end of the side wall, said girts extended upwardly and inwardly under the roof, said means attaching the upper portion of the liner means to the support including means connected to each girt.

8. The apparatus of claim 7 wherein: the means connected to each girt includes fastening means holding the upper portion of the liner means in engagement with each girt.

9. The apparatus of claim 1 including: an inner wall located adjacent the inside of the lower end of the side wall, said floor means engageable with the inner wall.

10. The apparatus of claim 9 wherein: said liner means has a lower portion thereof located between said inner wall and side wall.

11. The apparatus of claim 10 wherein: said means to accommodate a bottom material unloading machine includes a trough extended generally from the central portion of the floor to the side wall, said side wall having an opening aligned with the outer end of the trough for accommodating the discharge end of the material unloading machine.

12. An apparatus for converting a conventional tower silo to a bottom unloading sealed silo, said conventional tower silo, including an upright side wall having an inside surface surrounding a chamber storing material, an upper end, and a lower end anchored to the ground, a roof mounted on the upper end of the silo wall covering the upper end of the chamber comprising: air impervious liner means located in said chamber adjacent the inside surface of the side wall, an inner wall located adjacent the inside of the lower end of the side wall, said liner means having a lower portion thereof located between said inner wall and side wall, means attaching the liner means to the side wall to hold the liner means in engagement with said inside surface, said liner means having an upper portion located below the roof, support means extended upwardly from the side wall below said roof, means attaching the upper portion of the liner means to the support means, and a floor means at the lower end of the silo wall, said floor means being engageable with said inner wall forming the bottom of said chamber, said floor means having means to accommodate a bottom material unloading machine.

13. The apparatus of claim 12 wherein: said floor means, includes a trough extended generally from the central portion of the floor to the side wall for accommodating a material unloading apparatus.

14. The apparatus of claim 12 wherein: the means attaching the upper portion of the liner means to the support means includes yieldable means for biasing the upper portion of the liner means in an upward direction.

15. The apparatus of claim 14 wherein: the yieldable means comprises a plurality of springs connected to the support means and the upper portion of the liner means.

16. The apparatus of claims 14 or 15 wherein: the support means comprise a plurality of legs having lower ends mounted on the side wall and upper ends located adjacent each other, and means connecting said upper ends of the legs.

17. A method of converting a conventional tower silo having a side wall with an inside surface surrounding a chamber for accommodating material, a roof mounted on top of the side wall, and a bottom surrounded by a lower portion of the side wall comprising: removing the material from the bottom of the silo, providing an inner wall adjacent the inside of the bottom of the side wall, filling the space surrounded by said inner wall with aggregate, covering the aggregate and inner wall with a concrete floor having a radial trough for accommodating a bottom unloader, providing in the side wall a material exit opening aligned with the trough to accommodate the discharge end of the material unloader, positioning an air impervious liner adjacent the inside surface of the side wall, attaching the air impervious liner to the side wall of the silo, mounting a fill hatch to the center of the roof, locating support members under the roof between the top of the side wall and hatch, and attaching the upper portions of the liner to the support members.

18. The method of claim 17 including: locating the lower portion of the liner between the side wall and inner wall.

19. The method of claim 17 including: cleaning the inside surface of the side wall, applying an adhesive to the cleaned inside surface of the side wall, and placing the liner in surface engagement with the adhesive to secure the liner to the side wall.

20. The method of claim 17 wherein: the liner is secured to the side wall with fastening means.

21. The method of claim 20 including: placing holes in the side wall of the silo, and inserting the fastening means in said holes.

22. The method of claim 17 wherein: the liner comprises a plurality of liner sheets having side edges, including locating the liner sheets in upright side-by-side locations adjacent the inside side wall, and securing adjacent side edges of the liner sheets together.

23. The method of claim 22 wherein: each liner sheet is secured to the side wall.

24. The method of claim 22 wherein: each liner sheet is secured to the inside surface of the side wall with an adhesive.

25. The method of claim 22 wherein: each liner sheet is secured to the side wall with fastening means.

26. The method of claim 17 including: biasing the upper portion of the liner in an upward direction with biasing means that attach the upper portion of the liner to the support members.

27. A method of converting a conventional tower silo having a side wall with an inner surface surrounding a chamber for accommodating material, a roof mounted on top of the side wall with an inner surface surrounding a chamber for accommodating material, a roof mounted on top of the side wall, and a bottom surrounded by the lower portion of the side wall comprising: adding a floor having means for accommodating a bottom material unloader to the lower end of the chamber, providing in the side wall a material exit opening aligned with the unloader to accommodate the discharge end of the material unloader, positioning an air impervious liner adjacent the inside surface of the side wall, thereby surrounding said chamber with said liner, attaching the liner to said side wall, locating support members on the side wall under the roof, attaching the upper portion of the liner to the support members and allowing air to flow through an upper portion of the liner whereby air flows into and out of the chamber to substantially equalize the inside and outside air pressure.

28. The method of claim 27 including: providing an inner wall adjacent the inside of the bottom of the side wall, and adding said floor over said inner wall.

29. The method of claim 28 including: adding a base of aggregate in the space surrounded by said inner wall, and covering said aggregate with said floor.

30. The method of claim 27 wherein: said means for accommodating a bottom material unloader is a generally radial trough extended from the central area to the side wall.

31. A method of converting a conventional tower silo having a side wall with an inner surface surrounding a chamber for accommodating material, a roof mounted on top of the side wall, and a bottom surrounded by the lower portion of the side wall comprising: providing an inner wall adjacent the inside of the bottom of the side wall, adding a floor having means for accommodating a bottom material unloader to the lower end of the chamber, providing in the side wall a material exit opening aligned with the unloader to accommodate the discharge end of the material unloader, positioning an air impervious liner adjacent the inside surface of the side wall, locating the lower portion of the liner between the side wall and inner wall, adding said floor over said inner wall, attaching the liner to said side wall, locating support members on the side wall under the roof, and attaching the upper portion of the liner to the support members.

32. The method of claim 27 including: cleaning the inside surface of the side wall, applying an adhesive to the cleaned inside surface of the side wall, and placing the liner in surface engagement with the adhesive to secure the liner to the side wall.

33. The method of claim 27 wherein: the liner is secured to the side wall with fastening means.

34. The method of claim 33 including: placing holes in the side wall of the silo, and inserting the fastening means in said holes.

35. The method of claim 27 wherein: the liner comprises a plurality of liner sheets having side edges, including locating the liner sheets in upright side-by-side locations adjacent the inside side wall, and securing adjacent side edges of the liner sheets together.

36. The method of claim 35 wherein: each liner sheet is secured to the side wall.

37. The method of claim 35 wherein: each liner sheet is secured to the inside surface of the side wall with an adhesive.

38. The method of claim 35 wherein: each liner sheet is secured to the side wall with fastening means.

39. The method of claim 31 including: biasing the upper portion of the liner in an upward direction with biasing means that attach the upper portion of the liner to the support members.

40. The method of claim 39 including: providing a hatch opening in the upper portion of the liner to permit discharge of material into the space surrounded by the liner.

41. A tower silo for storing material comprising: an upright side wall having an inside surface, an upper end, and a lower end anchored to the ground, said side wall surrounding a chamber for accommodating material, roof means mounted on the upper end of the side wall covering the upper end of the chamber, air impervious liner means located in said chamber adjacent the inside surface of the side wall, means attaching the liner means to the side wall to hold the liner means in engagement with said inside surface, hatch means mounted on the roof means having an opening providing access to the upper end of the chamber, and means for closing the opening, said liner means having an upper portion extended to the hatch means, support means extended upwardly from the side wall to the hatch means, means attaching the upper portion of the liner means to the support means, an inner liner located adjacent the inside the lower end of the side wall, said liner means having a portion thereof located between said inner wall and said side wall, and floor means engageable with said inner wall forming the bottom of said chamber.

42. The silo of claim 41 wherein: said liner means comprises a plurality of upright liner sheets arranged in side-by-side positions adjacent the inside surface of the side wall, adjacent liner sheets having adjacent longitudinal edges, means securing said adjacent edges together, and said means attaching the liner means to the side wall including means to attach each liner sheet to the side wall.

43. The silo of claim 42 wherein: said means attaching each liner sheet to the side wall includes fastening means anchored to the side wall holding the liner sheet in engagement with the inside surface of the side wall.

44. The silo of claim 43 wherein: the fastening means include nut and bolt assemblies extended through holes in the side wall.

45. The silo of claim 42 wherein: said means attaching each liner sheet to the side wall includes adhesive means attaching the outer side of the liner sheet to the inside surface of the silo wall.

46. The silo of claim 42 wherein: each liner sheet has an upwardly tapering upper end portion.

47. The silo of claim 41 including: air vent means mounted on the upper portion of the liner means operable to allow air to flow into and out of the chamber to substantially equalize the inside and outside air pressure.

48. The silo of claim 42 wherein: said floor means includes a trough extended generally from the central portion of the floor to the side wall for accommodating a material unloading apparatus.

49. The silo of claim 48 wherein: said side wall has an opening aligned with the outer end of the trough for accommodating the discharge end of the material unloading apparatus.

50. The silo of claim 41 wherein: the means attaching the upper portion of the liner means to the support means includes fastening means.

51. The silo of claim 50 wherein: the fastening means include nut and bolt assemblies.

52. The silo of claim 41 wherein: the support means comprise a plurality of arched girts having lower ends supported on the upper end of the side wall and upper ends located adjacent the hatch means, said means attaching the upper portion of the liner means to the support means including fastening means connected to each girt.

53. The silo of claim 41 wherein: the means attaching the upper portion of the liner means to the support means includes yieldable means for biasing the upper portion of the liner in an upward direction.

54. The apparatus of claim 53 wherein: the yieldable means comprises a plurality of springs connected to the support means and the upper portion of the liner means.

55. The apparatus of claim 53 or 54 wherein: the support means comprise a plurality of legs having lower ends mounted on the side wall and upper ends located adjacent each other, and means connecting said upper ends of the legs.

* * * * *